US006296050B1

(12) United States Patent
Brinck, II

(10) Patent No.: US 6,296,050 B1
(45) Date of Patent: Oct. 2, 2001

(54) HEAT EXCHANGER

(76) Inventor: Joseph A. Brinck, II, 5545 Annamarie Ct., Cincinnati, OH (US) 45247

( * ) Notice: Subject to any disclaimer, the term of this patent is extended or adjusted under 35 U.S.C. 154(b) by 0 days.

(21) Appl. No.: 09/134,019

(22) Filed: Aug. 14, 1998

(51) Int. Cl.[7] ..... F28F 9/02

(52) U.S. Cl. ..... 165/158; 165/159; 122/15; 122/17; 126/391; 126/360 R

(58) Field of Search ..... 165/158, 159; 122/17, 15; 126/391, 360 R

(56) References Cited

U.S. PATENT DOCUMENTS

| | | | | |
|---|---|---|---|---|
| H52 | * | 4/1986 | Brackenbury | 165/158 |
| 341,625 | * | 5/1886 | Archer | 122/17 |
| 1,790,454 | | 1/1931 | Arrowsmith . | |
| 2,400,653 | * | 5/1946 | O'dowd | 126/391 |
| 2,501,419 | | 3/1950 | St. Clair . | |
| 2,532,527 | * | 12/1950 | Woodlery | 122/75 |
| 3,353,528 | | 11/1967 | Robinson . | |
| 3,360,037 | * | 12/1967 | Ammon | 165/158 |
| 3,688,760 | | 9/1972 | Rudin . | |
| 4,174,273 | | 11/1979 | Cros et al. . | |
| 4,465,024 | | 8/1984 | Adams . | |
| 4,508,501 | | 4/1985 | Kühn . | |
| 4,545,329 | * | 10/1985 | Adams | 122/17 |
| 4,673,350 | | 6/1987 | Collier . | |
| 4,705,022 | | 11/1987 | Collier . | |
| 5,016,610 | | 5/1991 | Meguro et al. . | |
| 5,179,914 | | 1/1993 | Moore, Jr. et al. . | |
| 5,197,415 | * | 3/1993 | Stretch et al. | 122/17 |
| 5,207,212 | * | 5/1993 | Woollen, Jr. | 126/391 |
| 5,220,887 | * | 6/1993 | Hiddleston et al. | 122/17 |
| 5,437,249 | * | 8/1995 | Adams et al. | 122/17 |
| 5,666,943 | * | 9/1997 | Adams | 126/360 R |
| 5,666,944 | | 9/1997 | Ferguson . | |

FOREIGN PATENT DOCUMENTS

| | | |
|---|---|---|
| 566318 | 7/1960 | (BE) . |
| 383334 | 10/1923 | (DE) . |
| 3502340 | 8/1985 | (DE) . |
| 2632056 | 12/1989 | (FR) . |
| 2119078 | 11/1983 | (GB) . |

OTHER PUBLICATIONS

Eclipse Immerso–Jet Burner, Model "IJ–6" for 6" Immersion Tubes, Data 330–6, Sep. 1990, formerly H–80.

North American Hi–Capacity Immersion Tube Gas Burners, North American Mfg. Co., Cleveland, OH, Bulletin 4762, Dec. 1990.

Eclipse Information Guide, Immerso–Pak Stripped Burners, Series 100 IP, Info 355–1, Apr. 1991, formerly H–89.

Eclipse Tube Firing Burner, Model 63–TFB, Bulletin 310, Jun. 1994.

Eclipse Immerso–Pak Burners, Model 100 "IP" Stripped, Bulletin 355–1, Jul. 1994.

Eclipse Information Guide, Tube Firing Burner, Model 63–TFB, Info 310, Sep. 1994.

Eclipse Tube Firing Burners, ThermThief Series (version 1.0), Design Guide, No. 310, Mar. 1996.

ImmersoJet Burners, Model 2"IJ, Version 2.00, Data 330.2, May 1997.

ImmersoJet Burners, Model 4"IJ, Version 2.00, Data 330.4, May 1997.

* cited by examiner

*Primary Examiner*—Ira S. Lazarus
*Assistant Examiner*—Terrell McKinnon
(74) *Attorney, Agent, or Firm*—Dinsmore & Shohl LLP

(57) ABSTRACT

An improved heat exchanger includes a central chamber, preferably in the form of a tube, having a proximal end and a distal end. A return manifold is connected to the distal end of the central chamber. A plurality of tubes, which are preferably straight, are positioned around the central chamber. In one embodiment, two or more circumferential patterns of tubes, each at a different radius, are equally spaced around the central chamber. An exhaust manifold receives the tubes and includes an exhaust vent.

16 Claims, 4 Drawing Sheets

HEAT EXCHANGER

TECHNICAL FIELD

The present invention relates generally to heat exchangers.

BACKGROUND OF THE INVENTION

Heat exchangers are typically used to transfer heat from one fluid to another fluid. A common example of a heat exchanger is the radiator in a car which is used to cool the internal engine coolant. Hot engine coolant is pumped into the car's radiator, while at the same time ambient air passes over the radiator which cools the engine coolant. As such, heat is transferred from the engine coolant to the ambient air. Heat exchangers are also used to heat fluids. For instance, many industrial settings require heated tanks of liquids. Heat exchangers using gas powered burners are immersed in the tank which then heat the liquids within the tank.

SUMMARY OF THE INVENTION

An object of the invention is to provide an improved heat exchanger. Additional objectives, advantages and novel features of the invention will be set forth in the description that follows and, in part, will become apparent to those skilled in the art upon examining or practicing the invention. The objects and advantages of the invention may be realized and obtained by means of the instrumentalities and combinations particularly pointed out in the appended claims.

One aspect of the present invention is a heat exchanger comprising a central chamber and a first manifold connected to the central chamber. A plurality of straight tubes each having a proximal end and a distal end are connected to the first manifold at the distal end. The straight tubes are positioned around the central chamber. A second manifold is connected to the proximal ends of the straight tubes and has an exhaust vent.

Another aspect of the present invention is a heat exchanger comprising a center tube having a proximal end, a distal end, and a flowpath extending from the proximal end to the distal end. A first set of tubes are positioned in a circumferential pattern at a first radius around the center tube. The first set of tubes each have a proximal end, a distal end in fluid communication with the distal end of the center tube, and a flowpath from the distal end to the proximal end. A second set of tubes are positioned in a circumferential pattern at a second radius around the center tube. Each of the second set of tubes have a proximal end, a distal end in fluid communication with the distal end of the center tube, and a flowpath from the distal end to the proximal end. A vent is in fluid communication with the proximal ends of the first and second sets of tubes.

Still another aspect of the present invention is a heat exchanger for heating a fluid in a container. The heat exchanger has a flange sealingly mounted to the container. A center tube, immersed in the fluid, has a proximal end and a distal end. A return manifold is connected to the distal end of the center tube and is immersed in the fluid. A first set of straight tubes are positioned in a circumferential pattern at a first radius around the center tube and parallel to the center tube. Each of the first set of tubes have a proximal end and a distal end connected to the return manifold. A second set of straight tubes are positioned in a circumferential pattern at a second radius around the center tube and parallel to the center tube. Each of the second set of tubes have a proximal ends ani a distal end connected to the return manifold. The first and second sets of straight tubes are immersed in the fluid. An exhaust manifold is connected to the proximal end of the first and second sets of tubes. The exhaust manifold has a vent located outside the container. A burner capable of producing heated gases is positioned in the exhaust manifold and connected to the proximal end of the center tube. A flowpath for heated gases extends from the burner to the distal end of the center tube, to the return manifold, to the distal ends of the first and second sets of the tubes, to the proximal ends of the first and second sets of the tubes, to the exhaust manifold, to the vent.

Still other aspects of the present invention will become apparent to those skilled in the art from the following description of a preferred embodiment, which is by way of illustration, one of the best modes contemplated for carrying out the invention. As will be realized, the invention is capable of other different and obvious aspects, all without departing from the invention. Accordingly, the drawings and descriptions are illustrative in nature and not restrictive.

BRIEF DESCRIPTION OF THE DRAWINGS

The accompanying drawings, incorporated in and forming part of the specification, illustrate several aspects of the present invention and, together with their descriptions, serve to explain the principles of the invention. In the drawings.

Reference will now be made to the present preferred embodiment of the invention, an example of which is illustrated in the accompanying drawings, wherein like numerals indicate the same element throughout the views.

DETAILED DESCRIPTION

Figure 1:
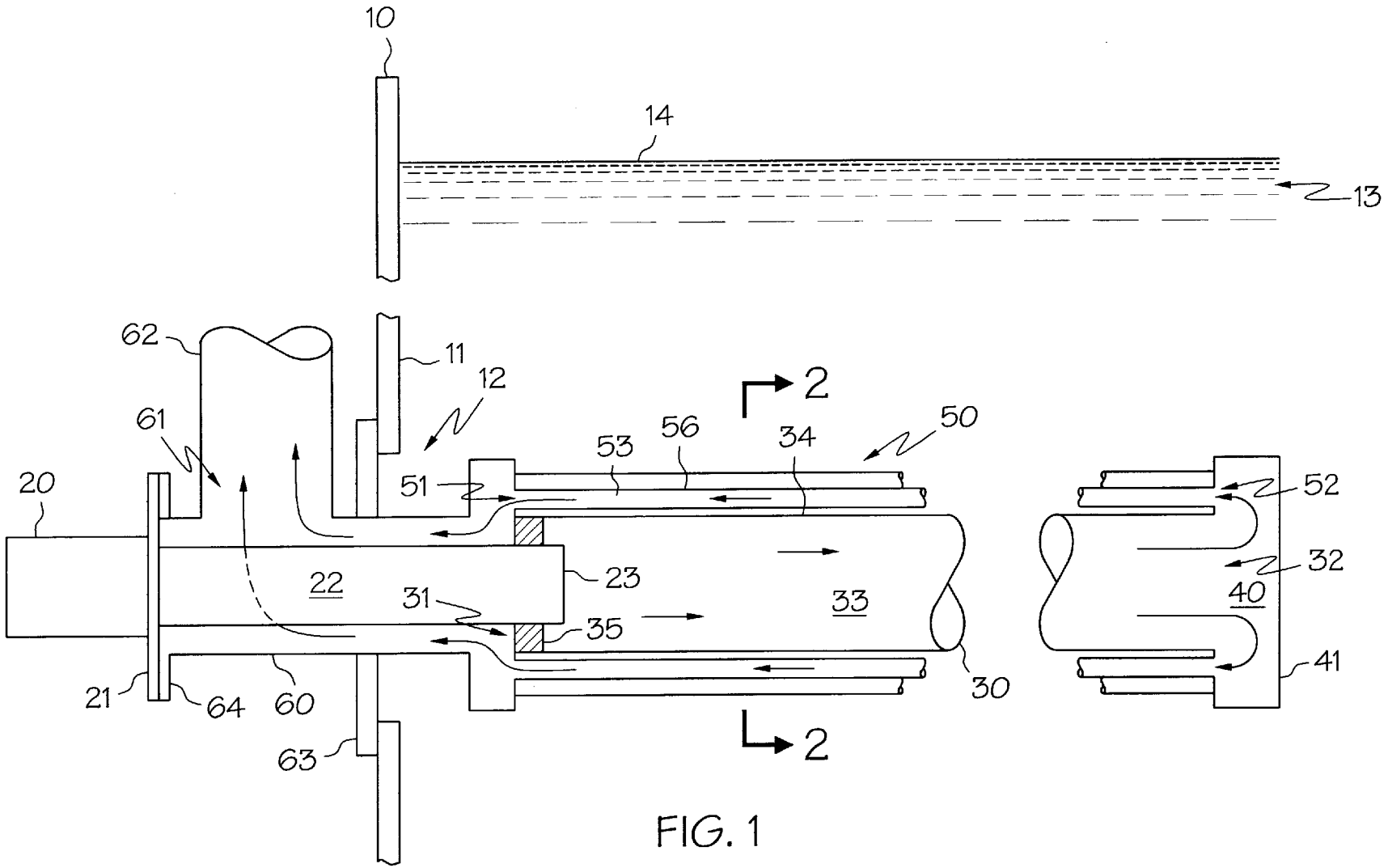
FIG. 1 illustrates a side view of one embodiment of a heat exchanger connected to an immersion tank.

One embodiment of the present invention is depicted in FIG. 1. This embodiment is using in conjunction with an immersion tank 10 which contains a fluid 13, such as water. One with ordinary skill in the art will readily appreciate that the present invention can be used in other applications and further can be used to heat or cool any fluid, whether it be a liquid or gas. For the purposes of illustration, the fluid 13 in this embodiment is contained by the immersion tank 10 and is filled to the fluid level 14. The immersion tank 10 includes a tank wall 11 having an opening 12 which receives the heat exchanger.

The burner 20 provides a source of heated gases which are used to heat the fluid 13. In one preferred embodiment, a standard tube firing burner similar to the disclosure of U.S. Pat. No. 4,673,350 is implemented. Naturally, any other source of heated gas could alternatively be used, including for instance, electric resistance heating, heated gases from an external source such as steam or escaping gases from a separate system, and the like. The burner 20 is connected to the heat exchanger by the flange 21 which is joined to the flange 64. The flange 64 is dimensioned such that it is capable of receiving a variety) of different sized burners or alternative sources of heated gases. The burner tube 22 is positioned within the exhaust manifold 60 with the flame end 23 positioned within the central tube 30.

The central tube 30 provides a chamber within which flammable gases from the burner 20 are combusted. The central tube 30 has a proximal end 31, a distal end 32, and a flowpath 33 extending between the two ends 31, 32. The central tube 30 can take a variety of different shapes and sizes. For instance, one preferred embodiment has a central tube 30 made of a 6 inch diameter steel tubing, preferably carbon steel or stainless steel, and is about 61 inches in length. Positioned within the proximal end 31 of the central tube 30 is a burner interface 35 which receives the flame end 23 of the burner tube 22. The burner interface 35 is preferably made of the same material as the central tube 30, but can be made of different materials. The central tube 30 is immersed in the fluid 13 such that the outside surface 34 is wetted by the fluid 13. This wetted outside surface 34 provides a heat transfer surface.

Attached to the distal end 32 of the central tube 30 is a return manifold 40. Preferably, the return manifold is made of the same material as the center tube 30 and is joined by a process such as welding or brazing. Alternatively, the return manifold 40 could be fastened to the central tube 30, such as with a flange, or integral to the central tube 30, such as a formed or cast portion. The return manifold 40 is immersed in the fluid 13 such that the outer surface 41 is wetted, therefore providing another heat transfer surface.

Figure 2:
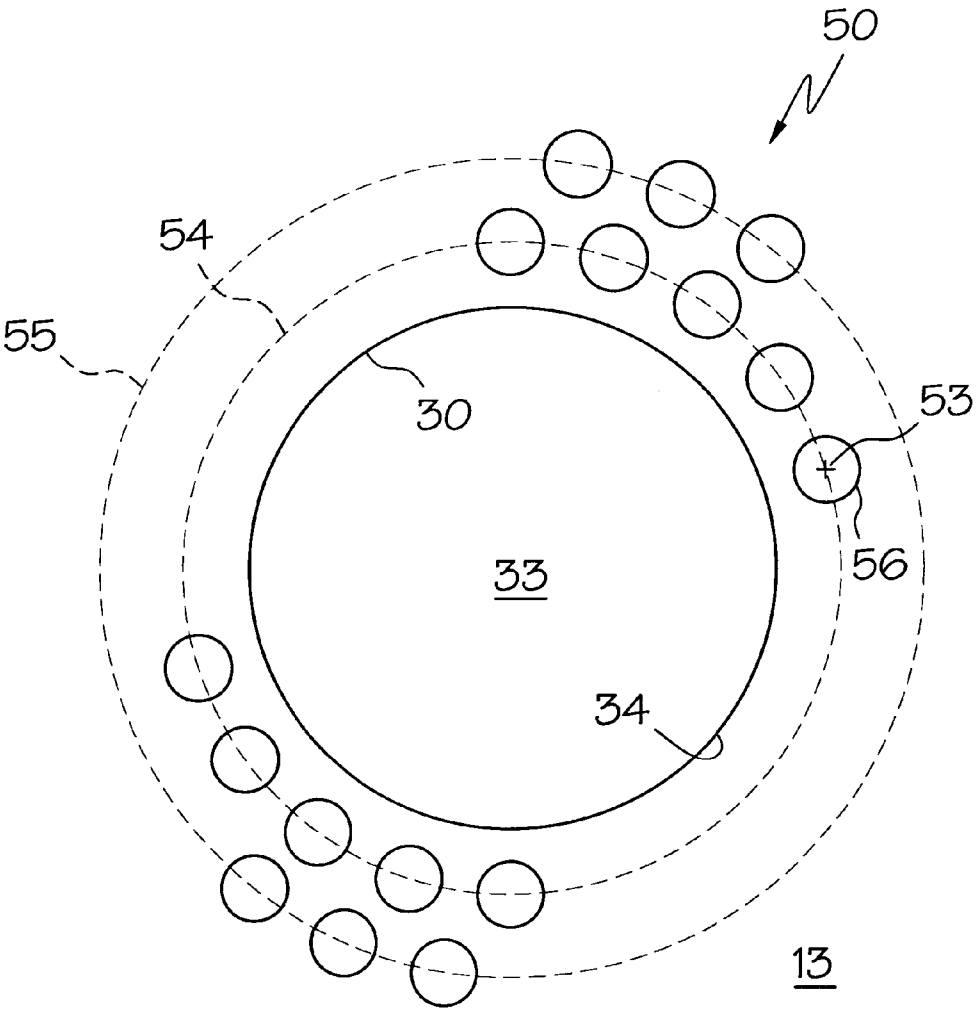
FIG. 2 illustrates a cross-sectional view of the heat exchanger depicted in FIG. 1.

A plurality of return tubes 50 are positioned around the central tube 30. Preferably, the return tubes 50 are straight and are positioned in a circumferential pattern about the central tube 30. As best illustrated in FIG. 2, one embodiment of the invention includes two circles of return tubes 50 positioned at a first radius 54 and a second radius 55 around the central tube 30. In other embodiments, three or more circles of return tubes can be implemented. Preferably, the return tubes 50 are evenly spaced relative to one another. For instance, one preferred embodiment has ¾ inch return tubes 50 spaced 1⅛ inches from center, with a first radius 54 of 3¾ inches and a second radius 55 of 4⅝ inches, resulting in a total of forty-five return tubes 50.

Each return tube 50 includes a proximal end 51, a distal end 52, and a flowpath 53 extending between the two ends 51, 52. The distal ends 52 are coupled to the return manifold 40, preferably in the same manner that the central tube 30 is coupled to the return manifold 40. Preferably, the return tubes 50 are made of the same material as the central tube 30 and the return manifold 40. One believed advantage of straight return tubes 50 is that connection stresses with the return and exhaust manifolds 40, 60 will tend to be uniform. Additional believed advantages of straight return tubes 50 are that they are easy to manufacture, do not require a bending operation, and are less likely to be fouled with dirt. As shown in the embodiment of FIG. 1, the return tubes 50 are immersed in the fluid 13 such that the outer surface 56 is wetted, therefore providing another heat transfer surface. Optionally, the return tubes 50 are approximately the same length as the central tube 30 and are positioned parallel to the central tube 30.

The exhaust manifold 60 is connected to the proximal ends 51 of the return tubes 50. The exhaust manifold 60 includes an exhaust vent 61 which is coupled to a flue 62 through which gases are vented. An optional tank flange 63 is coupled to the exhaust manifold 60 and joined to the tank wall 11 to provide structural support to the heat exchanger. The flange 63 is positioned relative to the exhaust manifold 60 such that a portion of the exhaust manifold 60 is wetted by the fluid 13 thus providing another heat transfer surface. Preferably, a seal or gasket (not shown) is positioned between the flange 63 and the tank wall 11 so as to provide a fluid-tight seal. A variety of mechanisms can be used to attach the tank flange 63 to the tank wall 11, such as bolts, screws, a threaded coupling, interference fit, welds, and the like.

In operation, heated gases in the form of flames exit the flame end 23 of the burner 20 into the flowpath 33. As illustrated by the flow arrows, the heated gases 33 move toward the distal end 32 of the central tube 30 and into the return manifold 40. The gases then enter the distal ends 52 of the various return tubes 50 and traverse towards the proximal ends 51. The gases then enter the exhaust manifold 60 flowing around the burner tube 22 and through the exhaust vent 61. The gases then enter the flue 62 and are vented accordingly. The heated gases heat the heat transfer surfaces, which in turn heat the fluid 13.

One advantage of the embodiment depicted in FIG. 1 is that the heat exchanger has a relatively large heat transfer surface including the multiple rows of return tubes 50, the return manifold 40, the central tube 30, and the exhaust manifold 60. The relatively high heat transfer surface results in a more efficient heat exchanger and lower flue gas temperatures. Further, the relatively large heat transfer surface results in lower surface temperature, which can be desirable for temperature sensitive fluids or fluids which may tend to cake on hot surfaces.

Figure 3:
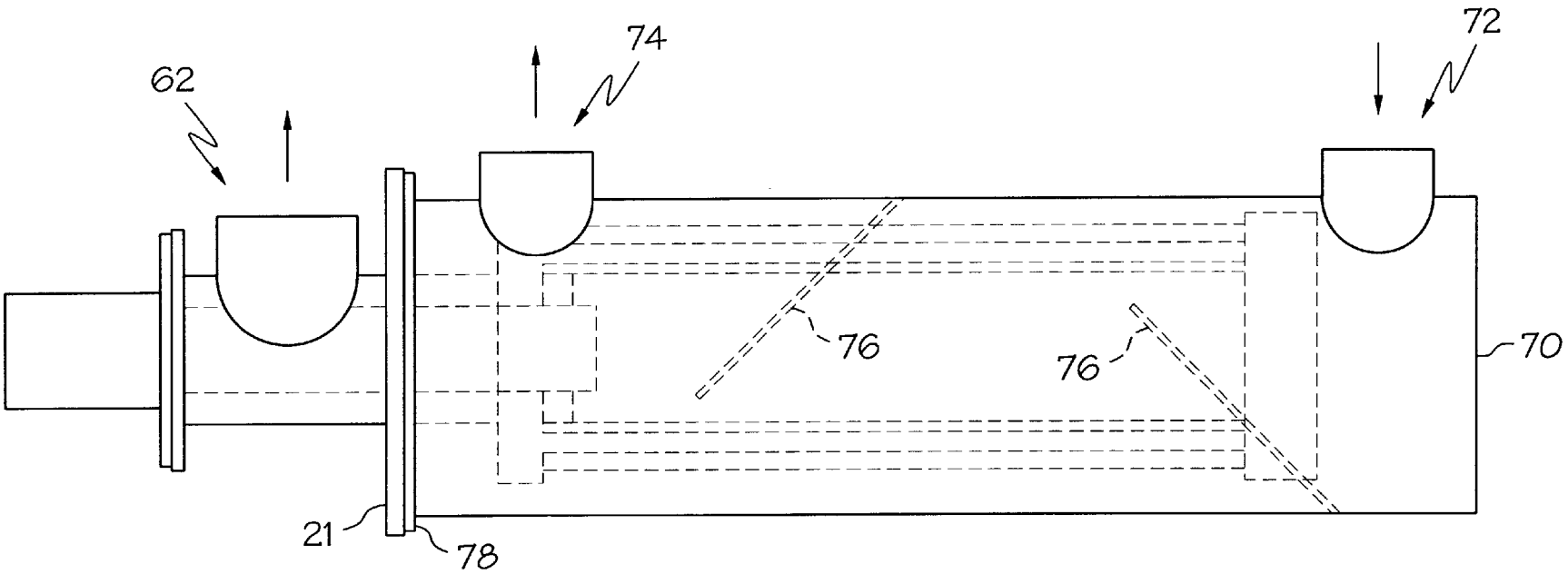
FIG. 3 illustrates one embodiment of a heat exchanger being used for extraneous heating of a fluid.

FIG. 3 illustrates an embodiment of the invention being used as an instantaneous fluid heater. The heat exchanger, shown in phantom, is inserted in the housing 70, which is preferably insulated. The flange 21 is coupled to the mating flange 78, thereby resulting in a fluid-tight seal with the housing 70. Fluid, whether it be a liquid or gas, enters the housing 70 through the inlet 72 and exits through the outlet 74. The fluids flow between the inlet 72 and outlet 74 circulates over and around the heat exchanger, thereby transferring heat to the fluid. Heat transfer efficiency can be increased by providing a housing 70 dimensioned to closely fit the heat exchanger, and further improve by including optional baffles 76, which result in additional fluid mixing within the housing 70.

Figure 4:
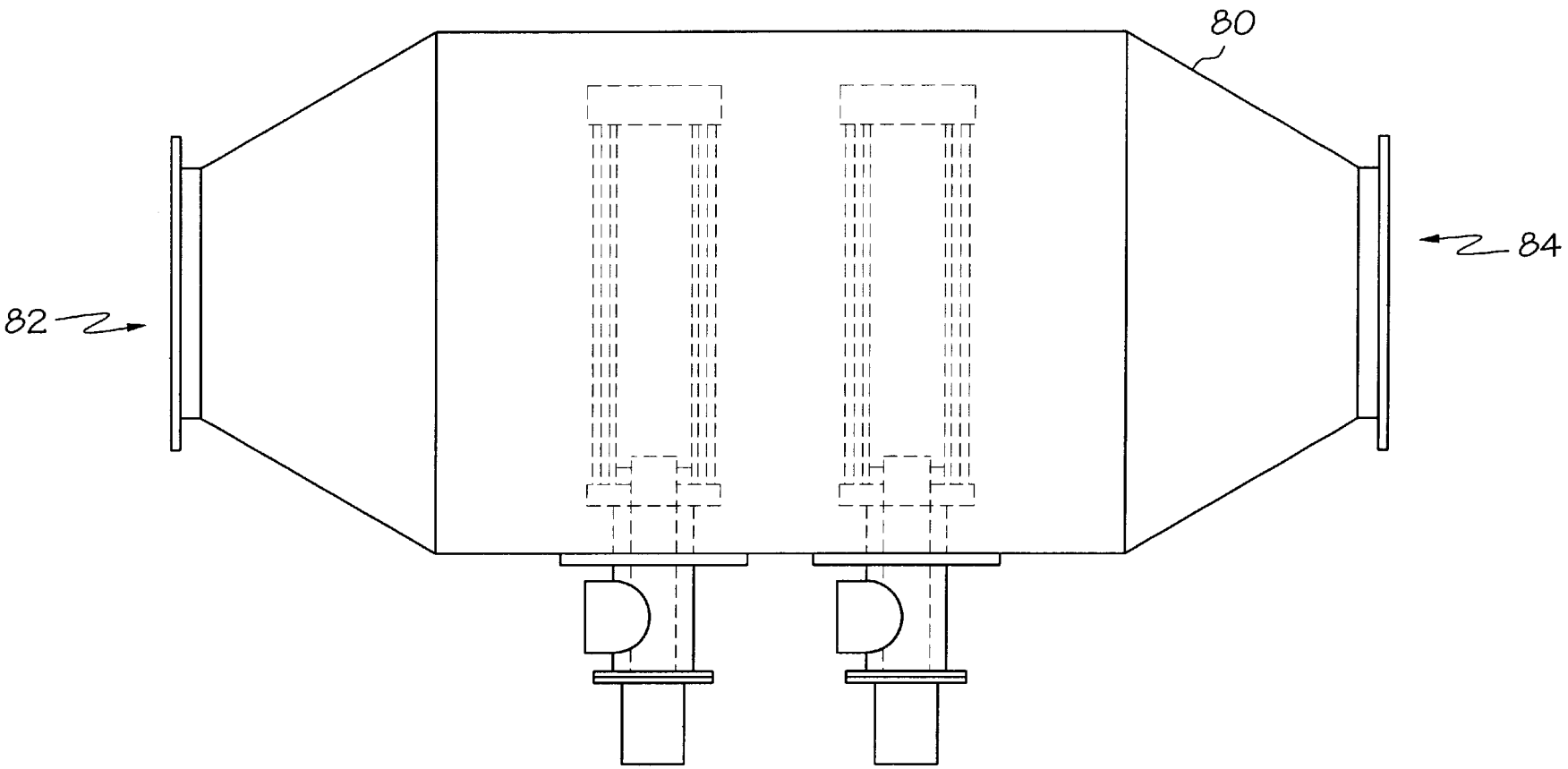
FIG. 4 illustrates one embodiment of a heat exchanger being used to heat air.

FIG. 4 illustrates an embodiment of the invention being used as a process air heater. Two or more heat exchangers are positioned within the duct 80. Forced air enters the duct 80 through the inlet 82 and circulates over and around the heat exchangers thereby heating the air. The heated air then exits the duct 80 through the outlet 84, which is then used accordingly. One with ordinary skill in the art will readily recognize that similar configurations can be used to heat any gas and is not limited to air.

The foregoing description of the preferred embodiment of the invention has been presented for purposes of illustration and description. It is not intended to be exhaustive nor to limit the invention to the precise form disclosed. Many alternatives, modifications, and variations will be apparent to those skilled in the art in light of the above teaching. Accordingly, this invention is intended to embrace all alternatives, modifications, and variations that fall within the spirit and broad scope of the amended claims.

We claim:

1. A heat exchanger, comprising:

a) a central chamber;

b) a first manifold connected to the central chamber;

c) a first plurality of straight tubes each having a proximal end and a distal end connected to the first manifold, said first plurality of straight tubes being arranged in a first circumferential pattern around the central chamber;

d) a second plurality of straight tubes each having a proximal end and a distal end connected to the first manifold, said second plurality of straight tubes being arranged in a second circumferential pattern around the central chamber;

e) a second manifold connected to the proximal ends of the straight tubes, said second manifold having an exhaust vent; and f) a burner tube having a flame end, wherein the flame end is positioned within the central chamber.

2. A heat exchanger as recited in claim 1, wherein the central chamber is a tube.

3. A heat exchanger as recited in claim 2, wherein the straight tubes are parallel with the central chamber tube.

4. A heat exchanger as recited in claim 2, wherein the straight tubes are substantially the same length as the central chamber tube.

5. A heat exchanger as recited in claim 1, wherein at least a portion of the burner is positioned in the second manifold.

6. A heat exchanger as recited in claim 1, further comprising a flange for mounting the heat exchanger to a tank.

7. A heat exchanger, comprising:

a) a center tube having a proximal end, a distal end, and a flowpath from the proximal end to the distal end;

b) a first set of tubes each having a proximal end, a distal end in fluid communication with the distal end of the center tube, and a flowpath from the distal end to the proximal end, said first set of tubes being positioned in a circumferential pattern at a first radius around the center tube;

c) a second set of tubes each having a proximal end, a distal end in fluid communication with the distal end of the center tube, and a flowpath from the distal end to the proximal end, said second set of tubes being positioned in a circumferential pattern at a second radius around the center tube; and d) a vent in fluid communication with the proximal ends of the first and second sets of tubes.

8. A heat exchanger as recited in claim 7, wherein the first set of tubes are equally spaced from one another.

9. A heat exchanger as recited in claim 7, wherein the second set of tubes are equally spaced from one another.

10. A heat exchanger as recited in claim 7, further comprising a return manifold connected to the distal end of the center tube and the distal ends of the first and second sets of tubes.

11. A heat exchanger as recited in claim 7, wherein the first and second sets of tubes are straight.

12. A heat exchanger as recited in claim 7, wherein the first and second sets of tubes are substantially the same length as the center tube and parallel to the center tube.

13. A heat exchanger for heating a fluid in a container, the heat exchanger comprising:

a) a flange sealing mounted to the container;

b) a center tube having a proximal end and a distal end, said center tube being immersed in the fluid;

c) a return manifold connected to the distal end of the center tube, said return manifold being immersed in the fluid;

d) a first set of straight tubes each having a proximal end and a distal end connected to the return manifold, said first set of tubes being positioned in a circumferential pattern at a first radius around the center tube and parallel to the center tube, said first set of tubes being immersed in the fluid;

e) a second set of straight tubes each having a proximal end and a distal end connected to the return manifold, said second set of tubes being positioned in a circumferential pattern at a second radius around the center tube and parallel to the center tube, said second set of tubes being immersed in the fluid;

f) an exhaust manifold connected the proximal ends of the first and second sets of tubes, said exhaust manifold having a vent located outside the container;

g) a burner capable of producing heated gases positioned in the exhaust manifold and connected to the proximal end of the center tube; and h) a flowpath for heated gases extending from the burner to the distal end of the center tube, to the return manifold, to the distal ends of the first and second sets of the tubes, to the proximal ends of the first and second sets of the tubes, to the exhaust manifold, to the vent.

14. A heat exchanger as recited in claim 13, wherein the first set of straight tubes are equally spaced relative to one another.

15. A heat exchanger as recited in claim 13, wherein the second set of straight tubes are equally spaced relative to one another.

16. A heat exchanger as recited in claim 13, wherein the first and second sets of straight tubes are substantially the same length as the center tube.

* * * * *

UNITED STATES PATENT AND TRADEMARK OFFICE

CERTIFICATE OF CORRECTION

PATENT NO. : 6,296,050 B1
DATED : October 2, 2001
INVENTOR(S) : Joseph A. Brinck, II It is certified that error appears in the above-identified patent and that said Letters Patent is hereby corrected as shown below:

Column 5,
Line 32, delete "and"
Line 34, replace "." with -- ; and
(e) a burner tube having a flame end, wherein the flame end is positioned within the center tube. --

Signed and Sealed this

Second Day of July, 2002

*Attest:*

*Attesting Officer*

JAMES E. ROGAN
*Director of the United States Patent and Trademark Office*